US006285291B1

(12) United States Patent
Knox et al.

(10) Patent No.: US 6,285,291 B1
(45) Date of Patent: Sep. 4, 2001

(54) DETECTION OF AIRBORNE POLLUTANTS

(75) Inventors: Ronald Knox, Mornington; Christopher T. Ryan, East Brunswick; Hugh Stevenson, South Yarra, all of (AU)

(73) Assignee: Vision Products Pty. Ltd., Clayton (AU)

( * ) Notice: Subject to any disclaimer, the term of this patent is extended or adjusted under 35 U.S.C. 154(b) by 0 days.

(21) Appl. No.: 09/171,886

(22) PCT Filed: May 2, 1997

(86) PCT No.: PCT/AU97/00266

§ 371 Date: Oct. 28, 1998

§ 102(e) Date: Oct. 28, 1998

(87) PCT Pub. No.: WO97/42486

PCT Pub. Date: Nov. 13, 1997

(30) Foreign Application Priority Data

May 3, 1996 (AU) ..... PN 9659

(51) Int. Cl.[7] ..... G08B 17/10

(52) U.S. Cl. ..... 340/634; 340/628; 340/237; 340/629; 340/521; 340/586

(58) Field of Search ..... 340/628, 634, 340/237, 629, 521, 586, 577, 333; 73/23.2, 23.3; 55/213, 270, 271, 274

(56) References Cited

U.S. PATENT DOCUMENTS

| | | | | |
|---|---|---|---|---|
| 4,254,414 | * | 3/1981 | Street et al. | 340/627 |
| 4,608,556 | * | 8/1986 | Cole | 340/628 |
| 4,617,560 | * | 10/1986 | Gutmann | 340/628 |
| 5,424,842 | | 6/1995 | Poorman | 256/438 |
| 5,552,775 | * | 9/1996 | Harley | 340/628 |
| 5,589,824 | * | 12/1996 | Lynch | 340/628 |
| 5,610,592 | * | 3/1997 | Okazaki | 340/628 |
| 5,917,417 | * | 6/1999 | Girling et al. | 340/628 |

FOREIGN PATENT DOCUMENTS

| | | | |
|---|---|---|---|
| 3237021 A1 | * | 5/1983 | (DE) . |
| 0324 295 A2 | | 7/1989 | (EP) . |
| 0 521 725 A2 | | 1/1993 | (EP) . |
| 0 586 363 A1 | | 3/1994 | (EP) . |
| 1 079 929 | | 8/1967 | (GB) . |
| 1 549 193 | | 7/1979 | (GB) . |
| 2 097 531 | * | 3/1982 | (GB) . |
| 2 261 502 | | 5/1993 | (GB) . |
| 2 274 332 | | 7/1994 | (GB) . |
| WO 96/07166 A1 | * | 3/1996 | (WO) . |

OTHER PUBLICATIONS

T.T. Mercer, *Aerosol Techology in Hazard Evaluation,* Academic Press, Inc., pp. 244–248, 1973.*

* cited by examiner

*Primary Examiner*—Jeffery A. Hofsass
*Assistant Examiner*—Hung Nguyen
(74) *Attorney, Agent, or Firm*—Wolf, Greenfield & Sacks, P.C.

(57) ABSTRACT

A smoke detection system comprises a manifold (4) connected to a series of sampling pipes (2). A fan (6) which draws a large volume of sampling air through the sampling pipes is connected to the inlet manifold and a small proportion of that air is directed to the inlet of a smoke detector (12), the outlet of which is connected to the manifold. The configuration obtained by the connection of the outlet from the detector into the inlet manifold provides a large pressure drop across the flow path through the detector. As a result of the large pressure drop, a filter (10) for removing dust and other contaminants can be incorporated in the flow path and the filter can also incorporate a fine filtering stage to produce a secondary clear air flow which can be directed into the detector to prevent smoke particles from settling on critical components of the detector.

17 Claims, 4 Drawing Sheets

DETECTION OF AIRBORNE POLLUTANTS

FIELD OF THE INVENTION

The present invention relates to a system for the detection of airborne pollutants. More particularly the invention relates to a system for detecting smoke and other airborne pollutants as may be generated in the event of a fire or in circumstances which can lead to a fire.

BACKGROUND OF THE INVENTION

Fire protection and suppressant systems which operate by detecting the presence of smoke and other airborne pollutants are well known. Upon a threshold level of smoke being detected, an alarm may be activated and operation of a fire suppressant system may be initiated. While the fire itself will cause damage, considerable damage can also be caused by operation of the fire suppression system, and subsequent removal of the suppressant can be quite hazardous. Many traditional suppressants, such as halon, are also ozone depleting making this use environmentally undesirable. A detection system which is sufficiently sensitive to detect an abnormal condition prior to the onset of a fire is very advantageous as it enables action to be taken at a very early stage before the onset of actual fire conditions. For example, when most substances are heated, even before heating occurs to a point at which a fire commences, emissions will be generated and if these can be detected by a very sensitive system, a warning provided at that very early stage may allow the problem to be detected and rectified, or the equipment turned off, before the fire actually starts.

It is also desirable for the detection system to have a wide dynamic range of operation whereby it is effective not only at low levels of smoke and other airborne pollutants as may be generated prior to the onset of actual fire conditions as discussed above, but also is able to detect a range of higher threshold levels of smoke and other pollutants. High levels of smoke will indicate a greater likelihood of there being a fire and the higher thresholds can trigger alarms to shut down air conditioning, close fire doors, call a fire fighting service, and eventually trigger a suppression system if the smoke level becomes sufficiently high.

It is known for detection systems to incorporate a sampling pipe network consisting of one or more sampling pipes with sampling holes installed at positions where smoke or pre-fire emissions can be collected. Air is drawn in through the sampling holes and along the pipe by means of an aspirator, or fan, and is directed through a detector at a remote location. Conventionally, the detector is in series with the aspirator and the pressure drop associated with the detector reduces the pressure drop across the pipe network and hence reduces overall flow through the pipes. Also, the flow through the detector tends to vary with ambient conditions and from installation to installation, and contaminants flowing through the detector can alter the detection characteristics over a period of time. Accordingly, it is difficult with prior sampling systems to achieve a constant high sensitivity which is repeatable from installation to installation and which is maintained over a substantial time.

SUMMARY OF THE INVENTION

According to one aspect of the present invention, there is provided a smoke detection system comprising an inlet for connection to one or more sampling pipes, aspirator means for drawing sampling air through the inlet, a smoke detector having a detector chamber for receiving sampling air discharged from an outlet of the aspirator means via flow control means, an outlet from the detector chamber being connected to said inlet, said flow control means permitting a small portion of the outlet flow from the aspirator means to be drawn through the detector chamber for detection purposes with substantially the entirety of the sampling air flow drawn through the inlet from the or each sampling pipe being discharged to exhaust from the outlet of the aspirator means, and optional filter means for filtering that part of the sampling air flow which is drawn into the detector chamber.

In accordance with the invention therefore and as will be explained in greater detail herein, the arrangement of the components as defined above results in a substantial pressure drop across the sampling pipe network which results in a substantial sampling air flow via the or each sampling pipe and which is substantially unaffected by the presence of the filter, if present, and the detector chamber. A commensurately large pressure drop is also subtended across the filter and detector chamber which provides advantages as will be discussed later.

In a preferred embodiment of the invention the filter provides a coarse filtering stage to remove dust particles from the sampling air flow and a fine filtering stage to provide a substantially clean air flow which is directed into the detector chamber to prevent contamination of critical components within the chamber which is likely to reduce the sensitivity of the detector.

The flow control means may comprise an orifice at the inlet to the filter, and/or at the outlet from the filter, and/or at the inlet to the detector chamber.

Preferably the filter is provided by a replaceable filter cartridge.

When the system is required also to detect the presence of specified gases, one or more gas sensors can to advantage be incorporated to sense the presence of such gases within the clean air flow downstream of the filter.

In an alternative embodiment of the invention a fine filtered clean air flow can be generated by a second aspirator independently of the sampling air flow.

In a preferred embodiment of the invention the detector is an optical detector and advantageously a detector of the type which operates by detection of optical scattering in the presence of smoke particles. In that case the fine filtered clean air is introduced into the detector chamber at positions to prevent contamination of the light source, and/or a scattered light detector, and/or a light absorber, with the fine filtered clean air being introduced into the chamber at a rate which is sufficient to prevent particles of smoke and other contaminants from settling on the components.

According to another aspect of the invention, there is provided a replaceable filter cartridge for a filter as defined above, said cartridge including a coarse filter stage in which coarser particles of dust and other contaminants are removed, an outlet leading from the coarse filter stage for coarse filtered air for sampling purposes, a fine filter stage for receiving a portion of the air flow filtered in the coarse filter stage and for fine filtering that portion to produce a substantially clean air flow, and an outlet for said clean air flow.

Preferably, the coarse filter stage is such as to remove dust and other particles of a size in excess of approximately 20 microns and preferably the fine filter stage is operative to remove substantially all particles in excess of approximately 0.3 microns. The coarse filter stage may include a filter medium formed by an open cell foam and the fine filter stage may comprise a filter medium formed by an ultra-fine filter cloth or filter paper.

Although a smoke detector with provision for introduction of clean air into the detector chamber to prevent contamination of critical parts of the detector is a particularly preferred feature of the detection system in accordance with the invention as defined above, such a smoke detector can, to advantage, also be incorporated in conventional detection systems.

Accordingly, in accordance with another aspect of the invention, there is provided a smoke detector having a detector chamber, an inlet for introducing an air flow to be sampled into the chamber, an outlet for said air flow from the chamber, means within the chamber for detecting the presence of smoke particles within the air flow, and means for introducing into said chamber clean air substantially free of smoke and other particles to prevent contamination of components of the detecting means by settling of smoke particles and other particles.

Preferably, the smoke detector is an optical detector, advantageously of the type which operates by detection of optical scattering in the presence of smoke particles in the sampled air flow. In that case the clean air is introduced into the detector chamber at positions to prevent contamination of the light source, and/or a scattered light detector, and/or a light absorber.

BRIEF DESCRIPTION OF THE DRAWINGS

An embodiment of the invention will now be described, by way of example only, with reference to the accompanying drawings, in which.

DETAILED DESCRIPTION

Figure 1:
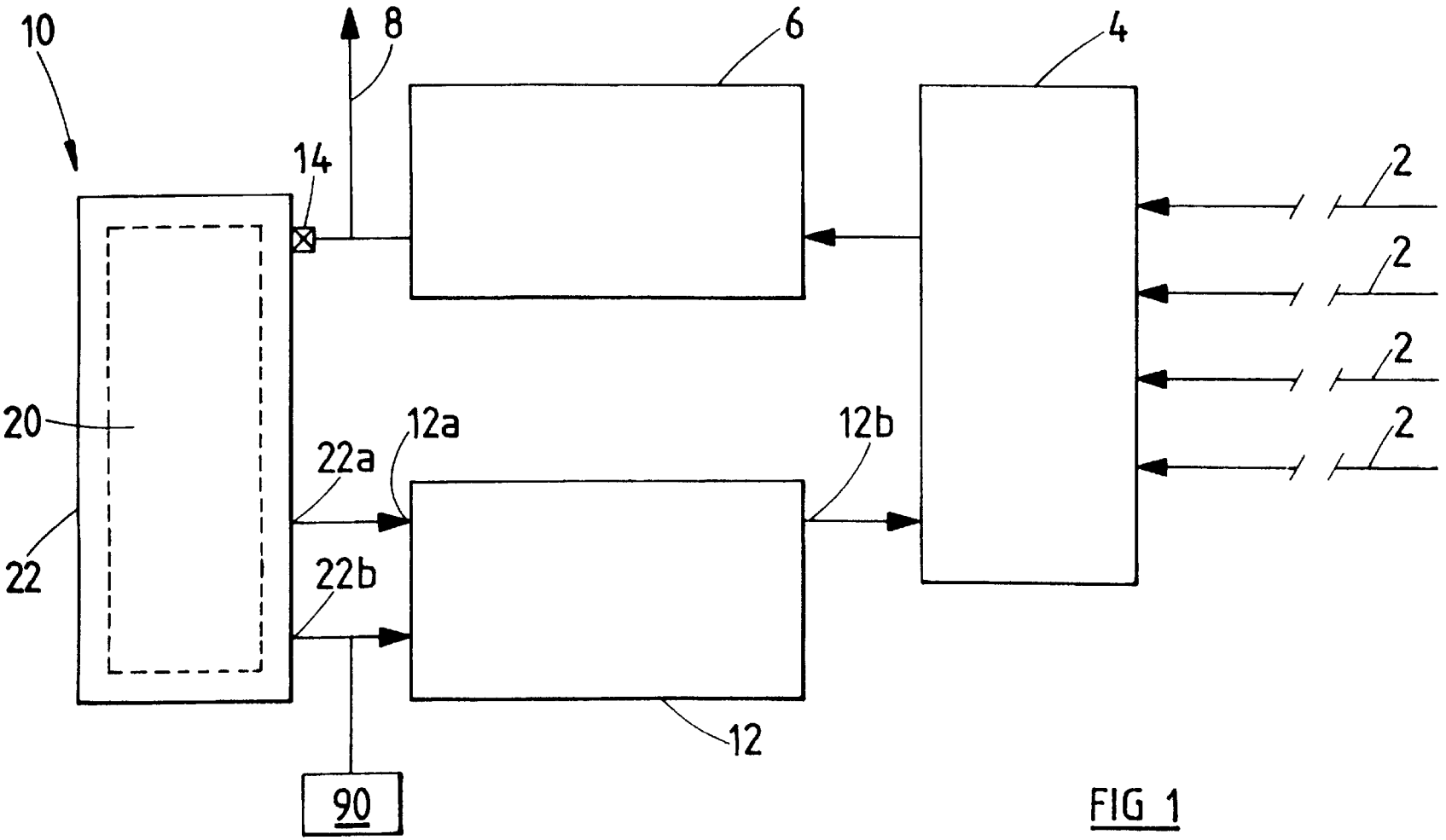
FIG. 1 is a block diagram showing, schematically, the pneumatic circuit of a detection system in accordance with a preferred embodiment of the invention.

In accordance with a preferred embodiment of the invention, a detection system comprises one or more sampling pipes 2 connected to a common inlet manifold 4. The or each sampling pipe 2 is positioned within a zone to be monitored by the detection system and is provided with sampling holes at selected positions along the length of the pipe in accordance with known practice. When, as is normally the case, more than one sampling pipe feeds into the inlet manifold 4, the pipes 2 are associated with a selector valve arrangement as will be discussed later. The inlet manifold 4 is connected to the suction inlet of a fan or other aspirator 6 which causes air to be drawn through the pipes 2 and into the inlet manifold 4. With the exception of a very small proportion of the total air flow through the aspirator 6 and which is used for sampling purposes as will be described, the outlet from the aspirator is discharged via an exhaust line 8 either directly to atmosphere or to an exhaust pipe. By way of illustrative example only, less than approximately 2% of the air flow drawn through the sampling tubes 2 and inlet manifold 4 by the aspirator 6 may be used for sampling purposes with at least 98% being discharged directly into the atmosphere via the exhaust line 8 and as a consequence of this, the very significant pressure drop which exists between the suction inlet and outlet of the aspirator 6 is available to draw air through the sampling pipe network.

The portion of the flow used for sampling purposes passes via a filter 10 into the inlet 12*a* of a detection chamber of a smoke detector 12, the flow outlet 12*b* from the detection chamber being connected to the inlet manifold 4 whereby the reduced pressure within the inlet manifold 4 acts to draw the sample flow through the filter 10 and detector 12. The proportion of the overall air flow (as generated by the aspirator 6) which is drawn through the filter and detector 12 is determined by a flow control orifice 14 between the outlet of the aspirator 6 downstream of the exhaust line connection and the inlet of the filter 10; alternatively, flow control orifices can be placed at the outlet(s) from the filter (10) or inlet(s) to the chamber of the detector 12.

It will be appreciated that with the arrangement just described, the high pressure drop across the aspirator 6 also results in a large available pressure drop across the filter 10 and smoke detector 12 due to the outlet connection back into the inlet manifold 4. This large pressure drop is significant in that it leads to a number of system advantages as will now be discussed. Firstly it enables the filter to be placed in the sample flow in series with the detector without reducing the overall air flow which can be drawn through the system. It also enables filtering to take place in two (or more) stages which is desirable for reasons which will be discussed later. The large pressure drop across the aspirator itself results in an improvement of the overall air flow through the sampling pipes because the filter and detector are not in series with the sampling pipe network and therefore the pressure drop is available to draw air through the pipes. The improved airflow also transports the air more quickly to the detector which reduces the response time to smoke in the sampled air from the far end of the pipes. It also results in a less variation in flow arising from variation in ambient conditions and due to different configurations of pipework.

Although within a given system the total air flow through the system will depend on factors such as the number of sampling pipes, the length of the sampling pipe network and the number of sampling points throughout the network, with the configuration described above variations in the overall air flow arising from these factors will not alter to any significant degree the amount of sampling air which will be drawn through the filter 10 and smoke detector 12 via the flow control orifice 14. Accordingly, irrespective of the actual manner in which the sampling pipework is set up, the amount of sampling air flow which will pass through the smoke detector 12 will be relatively constant and this is another factor which enables consistency of sensitivity to be obtained between different installations.

As previously discussed when, as is usually the case, more than one sampling pipe 2 leads into the inlet manifold 4, the tubes are associated with a selector valve arrangement. One form of selector valve arrangement comprises a respective valve between each sampling pipe 2 and the inlet manifold 4. Under normal conditions all the valves are open whereby sampling air is drawn simultaneously through all of the sampling pipes into the inlet manifold 4. If a smoke condition is detected by the detector 12 the valves are then closed and opened individually or in groups in sequence in order to identify which ones of the sampling pipes have delivered the air flow containing the detected smoke. Control of the valves in this way can readily be effected by the program control of the system.

Although within the broad scope of the invention any suitable form of smoke detector with an appropriate sensitivity can be used, it is preferred to use a detector of optical type, particularly an optical scatter detector which is able to provide good sensitivity at reasonable cost. Optical scatter detectors, which are known per se, operate on the principle that smoke particles or other airborne pollutants of small size when introduced into a detection chamber having a high intensity light beam will cause light scatter. The scattered light is sensed by a scattered light detector. The greater the amount of smoke particles within the sample introduced into the detector chamber, the greater will be the amount of light scatter; the scatter detector will detect the amount of scattered light and hence is able to provide an output signal indicative of the amount of smoke particles or other particles within the sample flow. It is to be noted that although in the system described herein the sample flow through the detection chamber is only a small percentage of the overall air flow drawn through the sampling tubes, statistically the proportion of smoke particles within the sampling air flow will be the same as that within the overall air flow and hence accuracy is not adversely affected.

The filter 10 is incorporated in the sampling air flow upstream of the inlet 12*a* to the smoke detector 12 in order to remove most dust particles and other contaminants from the sampling air flow, but not smoke particles from the sampling air flow and for this function the filter 10 removes from the sampling air flow particles of a size greater than approximately 20 microns. The filter 10 accordingly removes most contaminants from the sample air flow and hence enables increased sensitivity to the presence of the smaller smoke particles, and, as mentioned earlier, the presence of the filter 10 does not result in a reduction in overall air flow through the system. Also, it is to be noted that as only the small volume sampling air flow needs to be filtered, a relatively small capacity filter can be used.

As previously explained a significant pressure drop will exist between the inlet to the filter 10 and the flow outlet 12*b* from the smoke detector 12 leading into the inlet manifold 4. This substantial pressure drop enables the filter 10 to be multi-staged to provide a first filtering stage in which the dust and other particles in excess of approximately 20 microns are removed from the sampling air flow as just discussed, and at least a second stage which is a fine filter stage in which a small portion of the flow through the filter 10, for example 10 to 20% of the flow, is subject to further filtering to produce a "clean" air flow substantially free of smoke particles and other pollutants and which is used to maintain the optical sensitivity of the smoke detector.

In a smoke detector which operates on the optical scatter principle, smoke particles and small dust particles present within the sample air can, over a period of time, settle on and contaminate critical parts of the optical system such as the surface of the scattered light detector and other optical components of the system thereby reducing the sensitivity of the system. Contamination of this nature will also occur with other types of smoke detector. However in the system of the preferred embodiment of the invention, the clean air produced from the fine filter stage is introduced into the detection chamber at selected positions to prevent the accumulation of smoke particles or other small particles on critical parts of the detector. This will be described in greater detail later. A suitable filter for producing the filtered sampling air flow and the clean air flow will now be described with reference to FIGS. 2 and 3.

Figure 2:
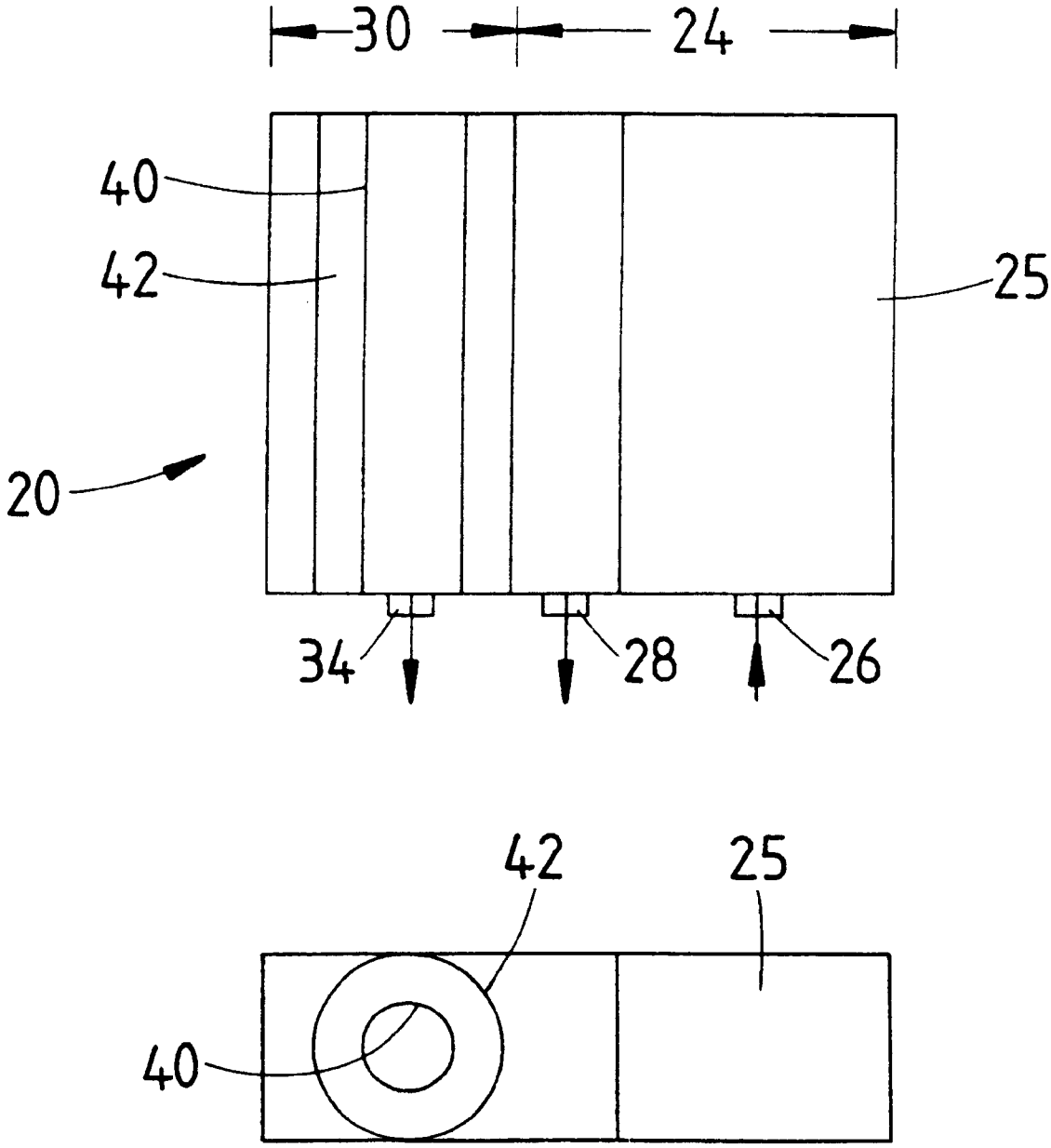
FIG. 2 shows schematically a cross-section through a filter cartridge of the system.
Figure 3:
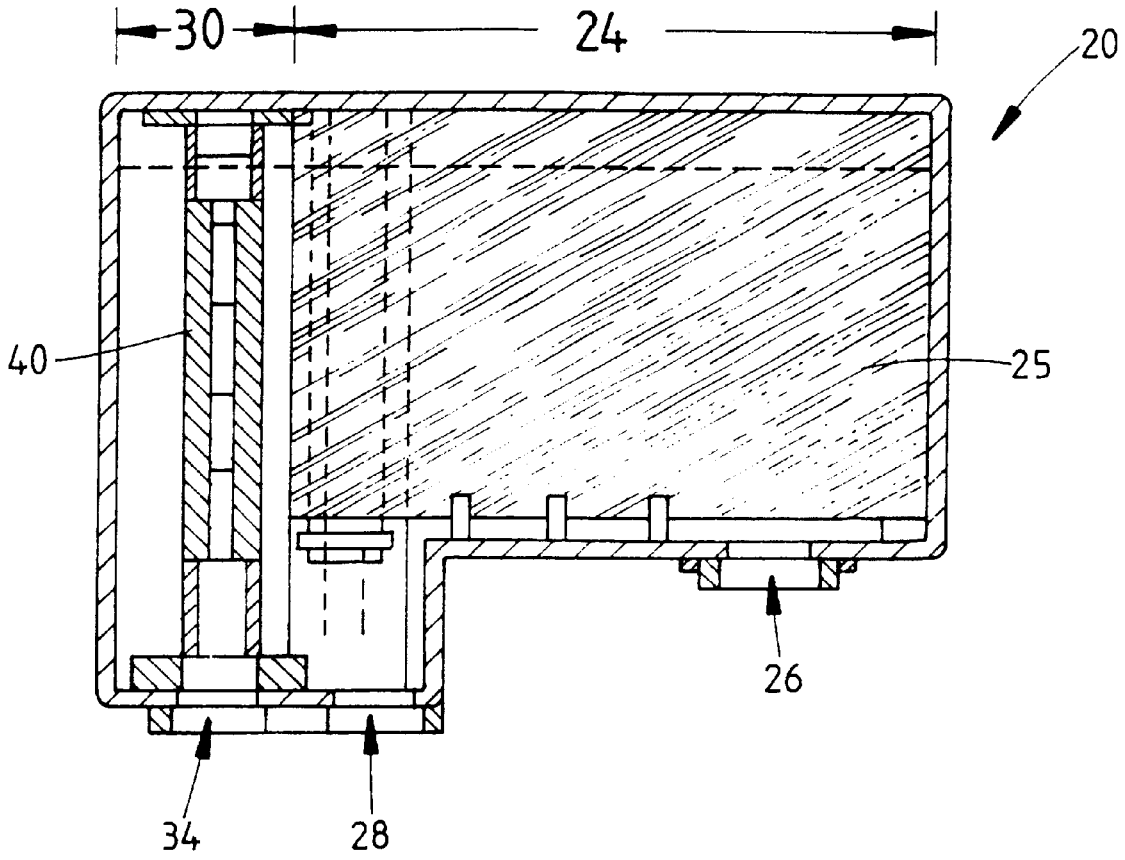
FIG. 3 is a more detailed cross-sectional view of the filter cartridge.

As shown in FIGS. 2 and 3, the filter 10 comprises a filter cartridge 20 removably mounted within an external support 22 (shown schematically in FIG. 1) having an inlet for the sampling air flow and separate outlets 22*a*, 22*b* respectively for the dust-filtered sampling air flow and for a flow of ultra-filtered, clean, air. The filter cartridge 20 has a first stage filter 24 for removing the coarser particles of dust and other contaminants. The first stage 24 may consist of an open cell foam 25, for example an open cell polyurethane foam, although any other suitable filter material could be provided. The sampling air flow is drawn into the first stage 24 of the filter cartridge 20 via an inlet 26 which communicates with the inlet in the external housing 22. The majority of the flow is withdrawn from the filter cartridge 20 via a first stage outlet 28 which communicates with the outlet 22*a* in the external support 22 and it is this flow which forms the sampling air flow which passes through the detection chamber of the detector 12. A second or fine stage filter 30 is defined within the filter cartridge 20 in series with the coarse filter stage 24. The fine filter stage 30 comprises a suitable fine filter, with an outlet 34 for clean filtered air and which communicates with the outlet 22*b* in the external support 22. A clean filtered air line leads from the outlet 22*b* into the detection chamber 12 at selected positions in order to prevent contamination as previously discussed. Accordingly, a proportion of the incoming sampling air drawn into the filter cartridge 20 via the inlet 26 is drawn into the fine filter 30 after passing through the coarse filter 25, to then be discharged through the clean air outlet 34. It will be appreciated therefore that the incoming sampling air is divided in the filter into two flows, the major flow being the coarse filtered flow which is used in the detector as the sampling air flow and the minor flow being the fine filtered clean flow and which is used in the detector to prevent contamination. As will be apparent, since the pressure drop or flow resistance across the fine filter stage 30 will be greater than that across the coarse filter stage 24, there is an inherent tendency for the major part of the flow to be drawn from the first stage outlet 28. However, the relative flows can also be controlled by the orifice size of the outlets 28, 34 or 22*a*, 22*b* and for this purpose orifice plates with different sized orifices can be fitted into the outlets in order to "tune" the system.

In the particular form shown, the fine filter stage 30 consists of a perforated bobbin core 40 wrapped with ultra-fine filter cloth or paper 42. The fine filter stage outlet 34 leads from the interior of the bobbin core 40 whereby the air to be filtered in the fine filter stage 30 is drawn from the course filter stage 24 externally of the bobbin core 40 through the filter cloth or filter paper 42 around the bobbin core 40 and into the interior of the bobbin core 40 for subsequent discharge. It is however to be understood that other suitable forms of fine filter could alternatively be used. In one preferred form of the invention the fine filter stage 30 serves to remove substantially 99.9% of particles in excess of 0.3 microns.

FIG. 2 shows the cartridge 20 somewhat schematically and FIG. 3 shows the cartridge in greater detail; in FIG. 3, the filter cloth or paper 40 has been omitted for clarity of illustration.

The filter cartridge 20 is replaceable and the system preferably contains means to indicate when the cartridge 20 needs to be replaced. Preferably, the cartridge 20 is clamped onto the external support 22 by one or more screws, and the inlet 26 and outlets 28, 34 of the cartridge 20 include compressible seals, for example in the form of foam plastics rings, which seal within the inlet and outlets of the external support 22.

As previously explained, preferably the smoke detector 12 operates on the principle of optical scattering within the detector chamber. The light source within the chamber may either be a broad band source or a narrow band source. Examples of broad band sources are incandescent light bulbs, arc lamps, and xenon flash lamps. A detector incorporating a xenon flash lamp is disclosed for example in Australian patent specification 577538 (AU-B-31843/84). Examples of narrow band light sources are filtered broad band light, LED's and LASERS. A particularly preferred form of detector using a LASER light source will be described with reference to FIG. 4.

Figure 4:
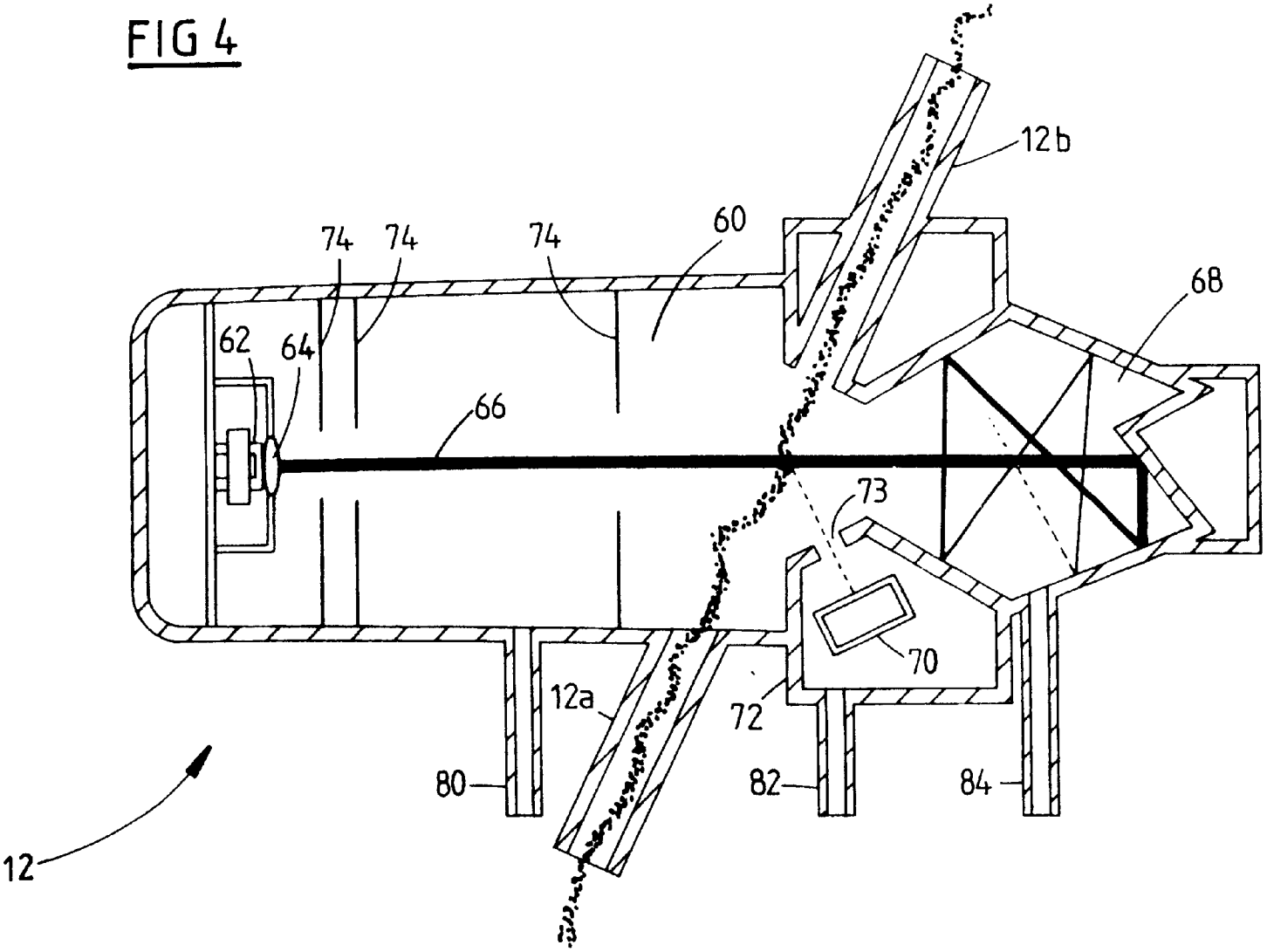
FIG. 4 is a schematic cross-section through the detection chamber of a preferred form of smoke detector incorporated in the system.

As shown in FIG. 4, the detector 12 comprises a detector chamber 60 of tubular form having at one end a light source in the form of a LASER diode 62 and lens 64 to produce a focussed beam 66 of light axially of the chamber 60. The beam 66 is directed into a light absorber 68 at the other end of the chamber. The light beam entering the absorber 68 is subject to multiple reflections within the absorber 68 so that it is absorbed and does not re-enter the chamber 60. The inlet and outlet 12*a*, 12*b* for the sampling air flow direct the sampling air flow obliquely across the chamber 60 through the path of the beam 66 at a position adjacent the absorber 68. A photo detector 70 for receiving scattered light is mounted within an enclosure 72 adjacent the absorber 68, the enclosure having an entry port 73. A set of collimator discs 74 is used to reduce stray light off the main axis. Inlets through which clean air from the fine filter stage 30 is bled into the chamber 60 are shown at 80, 82, 84. Clean air entering through the inlet 80 into the zone of the chamber 60 between the second and third collimator discs 74 serves to direct the sampling air away from the laser and lens assembly 62, 64. Clean air from the inlet 82 enters the detector enclosure 72 and flows out of the enclosure 72 via the entry port 73 and thereby prevents the sampling air from entering into the enclosure 72 and hence contaminating the light scatter detector 70. Finally, the inlet 84 directs clean air into the light absorber 68, to prevent sample air from entering into the absorber and contaminating the optical surfaces of the absorber. The clean air is drawn from the zone between the collimator discs 74, the detector enclosure 70 and the light absorber 68 into the outlet 12*b* via the interior of the chamber 60. Accordingly, contamination of the surfaces of these optical devices with smoke and other small sized particles with commensurate reduction in the sensitivity of the system is thereby prevented. The relative airflow into the inlets 80, 82, 84 can be controlled by an orifice at each inlet to enable the clean air flows to be tuned.

Although as shown, the detector 12 only has a single photo detector 70, more than one photo detector may be incorporated to receive scattered light. The respective detectors may be in different locations within the chamber 60 and/or of different types.

It is to be noted that the detector of FIG. 4 can, to advantage, also be used in conventional detection systems in order to provide improved sensitivity of detection which is maintained over a long period of time.

Although it is preferred to produce the clean air flow by appropriate filtering of the sampling air flow, it would be possible to generate an independent clean air flow using a separate aspirator or other fan in conjunction with appropriate filters.

In detection systems used for a so-called "clean room" or an environment substantially free of dust it would be possible for the filter to be omitted.

In some systems there is a requirement not only for smoke detection in order to sense a fire or pre-fire condition, but also to detect the presence of certain gases, for example liquid petroleum gas or gasoline vapour which may indicate leakage from a fuel source, carbon monoxide which may indicate a fault in a burner or furnace, or cigarette smoke. Detectors for a range of gases are known per se and a suitable range of gas detectors is produced by Motorola Inc. under the trade mark SENSEON. If a gas sensing capability is required for the system, suitable gas sensors can be incorporated into the clean air line between the fine filter stage 30 and the detector 12 as shown schematically at 90 in FIG. 1. Any such gases present within the air flow would not be removed by the coarse and fine filtering stages, but as the gas sensors 90 are exposed only to the clean air flow which is substantially free of other contaminants the effective life of the gas sensors can be significantly prolonged.

It is to be emphasised that although the preferred embodiment of the system uses a smoke detector which operates by detecting light scatter in the presence of smoke particles, the broad principles of the invention can still be used to advantage with other forms of optical smoke detectors and also detectors which do not operate optically. In this regard, the arrangement of the detector in the air flow circuit in the manner described permits a sampling air flow through the detector chamber which is not changed to any substantial degree by the layout of the sampling pipes and other variables affecting the system. Also, when filtering is provided (as will occur in the majority of cases), the filtering can be used to provide a fine filtered clean air flow which can be introduced into the detector chamber to prevent contamination of sensitive parts of the detector. This is achieved very simply by bleeding clean air into the detector chamber at critical positions which ensure that the flow of clean air prevents the accumulation of deposits from the sample air onto the critical zones.

The embodiments have been described by way of example only and modifications and additions are possible within the scope of the invention.

What is claimed is:

1. A smoke detection system comprising an inlet adapted for connection to one or more sampling pipes lying upstream of said inlet, an aspirator for drawing sampling air through the inlet, and a smoke detector having a detector chamber for receiving sampling air discharged from an outlet of the aspirator via a flow control, an outlet from the detector chamber being directly connected to said inlet, said flow control permitting a small portion of the outlet flow from the aspirator to be fed through the detector chamber for detection purposes with substantially the entirety of the sampling air flow fed through the inlet from the or each sampling pipe being discharged to exhaust from the outlet of the aspirator.

2. A smoke detection system according to claim 1, wherein the said inlet comprises an inlet manifold to which one or more sampling pipes can be connected.

3. A smoke detection system according to claim 2, wherein the aspirator comprises a fan.

4. A smoke detection system according to claim 1, comprising means for generating a fine filtered clean air flow which is separate from the small portion of the outlet flow and which is directed into the detector chamber to prevent contamination by smoke particles of one or more components the contamination of which would reduce the sensitivity of the detector.

5. A smoke detection system according to claim 1 comprising a filter for filtering the small portion of the outlet flow.

6. A smoke detection system according to claim 5, wherein the filter is operative to filter dust particles from the small portion of the outlet flow.

7. A smoke detection system according to claim 6, wherein the flow control comprises an orifice at the inlet to the filter, and/or at the outlet from the filter and/or at the inlet to the detector chamber.

8. A smoke detection system according to claim 6, wherein the filter provides a relatively coarse filtering stage to remove dust particles from the small portion of the outlet flow, and a fine filtering stage to provide a substantially clean air flow which is separate from the small portion of the outlet flow and which is directed into the detector chamber to prevent contamination by smoke particles of one or more components the contamination of which would reduce the sensitivity of the detector.

9. A smoke detection system according to claim 8, comprising a gas sensor operative to sense the presence of gases within the clean air flow downstream of the filter means.

10. A smoke detection system according to claim 8, wherein the detector is an optical detector of the type which operates by detection of optical scattering in the presence of smoke particles and has a first inlet for introducing the small portion of the outlet flow and at least one second inlet for introducing the fine filtered clean air into the detector chamber to prevent contamination of a light source, and/or a scattered light detector, and/or a light absorber, with the fine filtered clean air being introduced into the chamber at a rate which is sufficient to prevent particles of smoke and other contaminants from settling on the components.

11. A smoke detection system according to claim 8, wherein the filter is provided by a replaceable filter cartridge.

12. A replaceable filter cartridge for the smoke detector system according to claim 11, said cartridge including a coarse filter stage in which coarser particles of dust and other contaminants are removed, a first outlet leading from the coarse filter stage for coarse filtered air for sampling purposes, a fine filter stage for receiving a portion of the air flow filtered in the coarse filter stage and for fine filtering that portion to produce a substantially clean air flow, and a second outlet for said clean air flow, said second outlet being separate from said first outlet.

13. A filter cartridge according to claim 12, wherein the coarse filter stage is such as to remove dust and other particles of a size in excess of approximately 20 microns and the fine filter stage is operative to remove substantially all particles in excess of approximately 0.3 microns.

14. A filter cartridge according to claim 12, wherein the coarse filter stage comprises a filter medium formed by an open cell foam and the fine filter stage comprises a filter medium formed by an ultra-fine filter cloth or filter paper.

15. A filter cartridge according to claim 12, wherein the fine filter stage comprises a hollow core carrying a filter medium so arranged in relation to the coarse filter stage that coarse filtered air is drawn externally of the core through the filter medium and into the interior of the core for subsequent discharge.

16. A filter cartridge according to claim 12, comprising an external housing enclosing filter media forming the coarse and fine filter stages, the housing having an inlet for sampling air communicating with the filter medium forming the coarse filter stage, a first outlet for coarse filtered air from the first filter stage, and a second outlet for fine filtered air from the fine filter stage.

17. A filter cartridge according to claim 16, wherein the proportion of coarse filtered air drawn through the fine filter stage is determined by the pressure drop across the two stages and by means of orifice plates associated with the first and second outlets of the housing.

* * * * *